US011399639B1

(12) United States Patent
Corbat

(10) Patent No.: US 11,399,639 B1
(45) Date of Patent: Aug. 2, 2022

(54) SELF-RIGHTING PACKAGING FOR DISPLAY OF ITEM WITH APERTURE

(71) Applicant: Harbor Freight Tools USA, Inc., Calabasas, CA (US)

(72) Inventor: Jeffrey Jon Corbat, Lafayette, IN (US)

(73) Assignee: HARBOR FREIGHT TOOLS USA, INC., Calabasas, CA (US)

( * ) Notice: Subject to any disclaimer, the term of this patent is extended or adjusted under 35 U.S.C. 154(b) by 7 days.

(21) Appl. No.: 17/168,485

(22) Filed: Feb. 5, 2021

(51) Int. Cl.

| | |
|---|---|
| ***A47F 5/08*** | (2006.01) |
| ***A47F 7/00*** | (2006.01) |
| ***A47F 7/14*** | (2006.01) |
| ***A47F 5/00*** | (2006.01) |
| *B27B 5/29* | (2006.01) |

(52) U.S. Cl.
CPC ..... *A47F 5/0823* (2013.01); *A47F 5/0006* (2013.01); *A47F 5/0876* (2013.01); *A47F 7/0021* (2013.01); *A47F 7/0042* (2013.01); *A47F 7/0057* (2013.01); *A47F 7/143* (2013.01); *B27B 5/29* (2013.01)

(58) Field of Classification Search
CPC ..... A47F 5/0823; A47F 7/0021; A47F 1/128; A47F 5/0006; A47F 2005/0012; A47F 5/0861; A47F 5/0876; A47F 7/0042; A47F 7/0057; A47F 7/143; B27B 5/29; B25H 3/006; B25H 3/00
USPC ..... 211/7, 57.1, 59.1; 206/461, 495, 493, 206/349; 73/65.01
See application file for complete search history.

(56) References Cited

U.S. PATENT DOCUMENTS

| | | | | |
|---|---|---|---|---|
| 2,278,214 A * | 3/1942 | Pearson | G11B 33/04 294/158 |
| 4,064,992 A * | 12/1977 | Ralston | A47B 49/002 211/75 |
| 4,254,879 A * | 3/1981 | Maule | G11B 33/045 |
| 4,276,984 A * | 7/1981 | Simmons | A47F 5/0087 D7/708 |
| 4,458,871 A * | 7/1984 | van Allen | A47K 5/05 248/309.2 |

(Continued)

OTHER PUBLICATIONS https://www.ebay.com/p/1980419929, [retrieved from the internet Feb. 5, 2021]; 5 pages.

(Continued)

*Primary Examiner* — Jennifer E. Novosad
(74) *Attorney, Agent, or Firm* — McAndrews, Held & Malloy, Ltd.

(57) ABSTRACT

Display packaging packages an item to form a packaged item. The display packaging includes a front portion and a rear portion. The front and rear portions have apertures. The item has a through hole. The apertures in the front and rear portions and the item receive a display peg. When the item is held at least partially between the front portion and the rear portion, and when the display peg is received by the rear portion aperture, the through hole of the item, and the front portion aperture, the packaged item is rotatable to a plurality of non-resting orientations and only one resting orientation. When the packaged item is in any of the non-resting orientations, the packaged item automatically rotates to the resting orientation. The display packaging has displayed information. The displayed information is in a pre-determined orientation when the packaged item is in the resting orientation.

20 Claims, 10 Drawing Sheets

(56) References Cited

U.S. PATENT DOCUMENTS 4,473,206 A * 9/1984 Stillinger ..... F16M 11/14 248/346.06
4,702,368 A * 10/1987 Jones ..... B65D 75/36 206/45.24
4,832,294 A * 5/1989 Eidem ..... F16M 11/42 248/129
4,993,770 A * 2/1991 Groves ..... A63B 21/0724 294/158
5,165,767 A * 11/1992 Sakai ..... G11B 23/027
5,168,984 A * 12/1992 Walsh ..... A45C 11/323 206/38.1
5,505,351 A * 4/1996 Najarian ..... B65D 73/0064 223/DIG. 2
5,593,045 A * 1/1997 Eldon, III ..... A47F 5/0823 248/222.12
5,690,221 A * 11/1997 Yeh ..... G11B 33/0455 312/9.16
5,799,372 A * 9/1998 Brunner ..... F16M 11/10 16/342
5,966,991 A * 10/1999 Gosselin ..... H01Q 3/08 248/661
6,092,673 A * 7/2000 Woolnough ..... A47F 7/146 211/50
6,264,153 B1 * 7/2001 Ragner ..... B62B 9/26 224/482
6,729,468 B1 * 5/2004 Dobmeier ..... B23D 59/00 206/349
6,783,013 B1 * 8/2004 Spann ..... B25H 3/04 211/60.1
7,086,545 B2 * 8/2006 Mannion ..... B65D 81/3869 211/183
7,121,406 B2 * 10/2006 Timpe ..... G11B 33/0472 312/9.54
7,464,911 B1 * 12/2008 Yen ..... F16B 45/00 248/304
7,997,410 B2 * 8/2011 Ali ..... B65D 73/0014 206/495
8,069,983 B2 * 12/2011 Cross ..... B27B 5/29 206/349
8,899,538 B2 * 12/2014 Wertz ..... G09B 23/36 248/220.21
9,179,792 B2 * 11/2015 Harding ..... A45D 34/00
10,407,211 B2 * 9/2019 Rubinstein ..... A47F 3/08
2001/0037957 A1 * 11/2001 Matthews Brown .. A47C 7/383 5/636
2002/0162756 A1 * 11/2002 Seligman ..... A47G 1/12 206/0.8
2003/0029748 A1 * 2/2003 Hargrave-Thomas ..... B25H 3/006 206/349
2003/0038220 A1 * 2/2003 Catan ..... A47G 29/083 248/304
2003/0184103 A1 * 10/2003 Cauchy ..... B65D 23/0842 215/396
2004/0020806 A1 * 2/2004 German, III ..... B65D 77/00 206/349
2005/0029147 A1 * 2/2005 Lee ..... B65D 73/00 206/806
2005/0133389 A1 * 6/2005 Baublitz ..... B65D 75/22 206/349
2006/0086636 A1 * 4/2006 Kuo ..... B65D 73/0064 206/349
2006/0113205 A1 * 6/2006 Liu ..... B65D 75/54 206/349
2006/0118449 A1 * 6/2006 Samberg ..... B25H 3/006 206/349
2006/0138147 A1 * 6/2006 Wagner ..... B65D 1/0223 220/475
2006/0201843 A1 * 9/2006 Kellar ..... B65D 5/3621 206/469
2007/0090071 A1 * 4/2007 Campbell ..... B67D 3/0083 211/81
2007/0163915 A1 * 7/2007 Wu ..... B65D 73/0014 206/495
2009/0045085 A1 * 2/2009 Vax ..... B65D 73/0014 206/495
2009/0209186 A1 * 8/2009 Krauss ..... B24B 45/00 206/234
2009/0261005 A1 * 10/2009 Kasubowski ..... B23D 59/00 206/349
2010/0200527 A1 * 8/2010 Hernandez ..... A47F 7/0028 211/70.6
2010/0301179 A1 * 12/2010 Brown ..... B25H 1/10 384/513
2010/0320356 A1 * 12/2010 Maillard ..... G02B 7/1824 248/278.1
2011/0049326 A1 * 3/2011 Fuller ..... H02G 11/02 248/610
2012/0048772 A1 * 3/2012 Millstein ..... A47G 23/0225 206/557
2013/0328337 A1 * 12/2013 Melcher ..... B60R 1/076 248/560
2014/0124520 A1 * 5/2014 Allan ..... B65D 25/28 220/752
2014/0150313 A1 * 6/2014 Stevens ..... A47G 1/1613 248/223.41
2014/0251839 A1 * 9/2014 Shalon ..... G02C 5/02 206/5
2015/0184791 A1 * 7/2015 Chow ..... F16M 11/2021 108/138
2015/0251307 A1 * 9/2015 Wang ..... B65D 43/22 206/372
2016/0016190 A1 * 1/2016 Buswell ..... B05B 15/55 220/475
2021/0196059 A1 * 7/2021 Fritsch ..... A47F 5/0043

OTHER PUBLICATIONS http://www.afpschoolsupply.com/drafting-tape-3-4x60-yards-5-rl-cream-by-helix-61400-product-1074289.html, [retrieved from the internet Feb. 5, 2021]; 2 pages.

* cited by examiner

SELF-RIGHTING PACKAGING FOR DISPLAY OF ITEM WITH APERTURE

CROSS REFERENCE TO RELATED APPLICATIONS

[Not Applicable]

BACKGROUND

Generally, embodiments of the invention relate to display packaging used to package and display items and located on pegs (for example, items in a product display in a hardware store).

SUMMARY

According to embodiments of the present invention, display packaging packages an item and receives a display peg. The item includes a through hole through which the display peg is selectively receivable. The item together with the packaging constitutes a packaged item, which has a center of mass. The display peg is substantially horizontal. The display packaging may include a front portion and a rear portion. The item may be held at least partially between the front and rear portions. The item may be rotationally symmetric or asymmetric.

The front portion may be positioned at least partially in front of the item when the display packaging packages the item. The front portion may include an aperture, and at least a portion of the aperture is aligned with the through hole of the item. The front portion aperture may receive the display peg when the display peg is also received within the through hole of the item. The front portion aperture may have a substantially circular shape.

The rear portion may be positioned at least partially behind the item when the display packaging packages the item. The rear portion may include an aperture, wherein at least a portion of the rear portion aperture is aligned with the aperture of the front portion and the through hole of the item. The rear portion aperture may receive the display peg when the display peg is also received within the aperture of the front portion and the through hole of the item. The rear portion aperture may have a substantially circular shape. The rear portion aperture may be smaller than the front portion aperture.

When the item is held at least partially between the front portion and the rear portion, and when the display peg is received by the rear portion aperture, the through hole of the item, and the front portion aperture, the display packaging may be rotatable to a plurality of non-resting orientations and only one resting orientation. When the display packaging is in any of the non-resting orientations, the display packaging and the item received therein automatically rotate to the resting orientation. When the display packaging is in the resting orientation, the center of mass is disposed at an elevation lower than that the center of mass when the display packaging is in any of the non-resting orientations. The display packaging may have displayed information (e.g., displayed on the frontward face of the front portion or rear portion). The displayed information may be in a pre-determined orientation when the display packaging is in the resting orientation.

The display packaging may include at least one (e.g., four) connecting portions connected to the front portion and the rear portion when the display packaging packages the item. Adhesive may be located on some or all of the plurality of connecting portions. At least one of the connecting portions may have a region integrally connected to both the front portion and the rear portion.

When the display packaging packages the item, the front portion may directly contact the rear portion. The front portion may comprise thermoformed plastic (which may be substantially transparent such that text may be discernable when viewed through the front portion). The rear portion may include cardboard. When viewing the display packaging from the front, only a portion of the front surface of the item may be visible. Alternatively, the entire front surface of the item may be visible when viewing the display packaging from the front.

Figure 1:
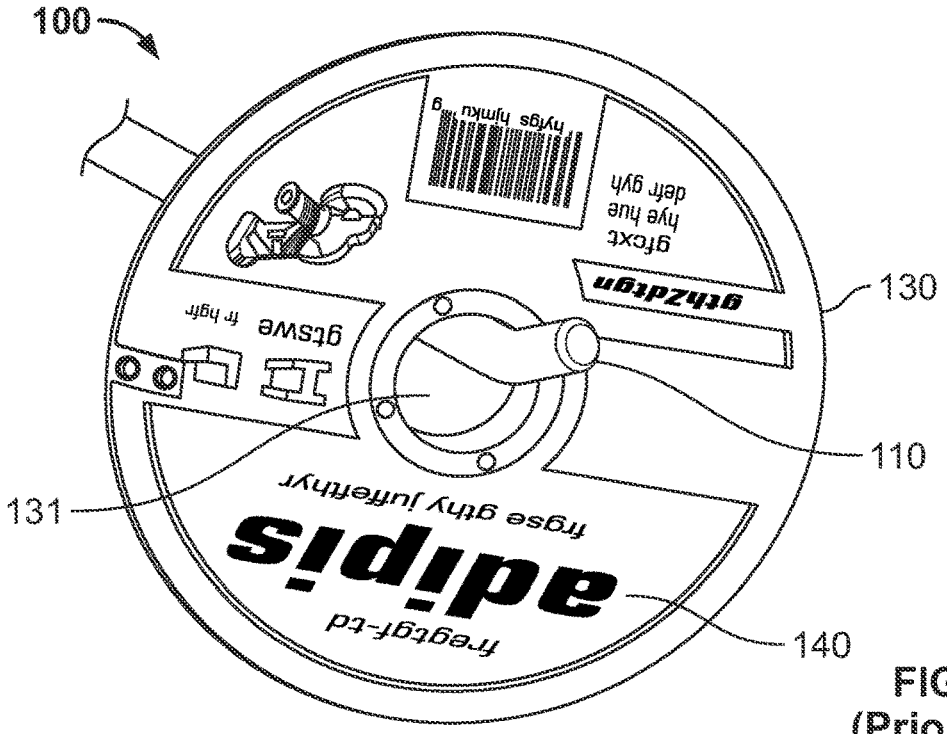
FIG. 1 (Prior Art)
FIG. 1 illustrates a prior art method of displaying an item on a conventional peg.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

FIG. 1 illustrates a prior art system 100 for hanging an item 130 from an aperture 131 in the item 130 from a conventional peg 110. Such an item 130 may be, as an example without limitation, a product for sale in a retail setting, such as a hardware store. Such products may include saw blades, cutting discs, grinding discs, or sanding discs. The item 130 may be rotationally symmetric or asymmetric. These types of items 130 include displayed information 140 (including labeling, text, logos, graphics, or images, for example) that should ideally be displayed in a pre-determined orientation (for example, substantially upright) in order for the displayed information 140 to be easily readable or otherwise identifiable to a customer. Yet, the item 130 is be capable of being oriented in a variety of positions other than the pre-determined orientation. For an item 130 that is rotationally symmetric, it will be understood that it may be oriented at any one of an infinite number of angular dispositions. In particular, when the item 130 is placed on the peg 110, it can be in a random orientation as shown in FIG. 1. There is only a relatively small chance that the item 130 will be in an orientation in which the displayed information 140 is in the pre-determined orientation. One solution to this problem is for stocking personnel to place such items 130 in the pre-determined orientations on pegs 110, both when replenishing inventory of the items 130 and after potential customers have removed and subsequently replaced items 130 on the peg 110. This, however, can be a relatively time-consuming or inconvenient task.

Figure 2:
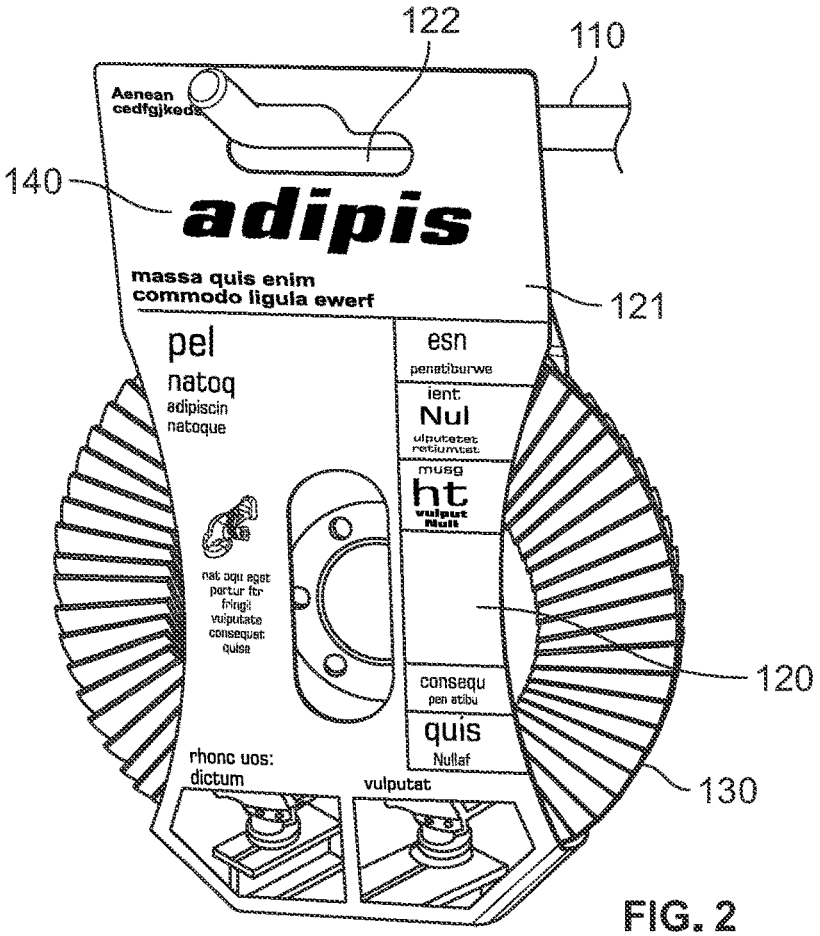
FIG. 2 (Prior Art)
FIG. 2 illustrates a further prior art method of displaying an item packaged in conventional packaging, wherein the conventional packaging is hanging from a conventional peg.

FIG. 2 depicts one known solution to the problem illustrated in FIG. 1. Specifically, display packaging 120 packages the item 130. The display packaging 120 includes an upwardly-extending portion 121 (e.g., a "hang tag") that extends upwardly from portions of the packaging that retain item 130. The upwardly-extending portion 121 includes an aperture 122 that receives peg 110. When the display packaging 120 hangs from the peg 110, the displayed information 140 is in a substantially pre-determined orientation (in this example, substantially upright). While such display packaging 120 facilitates displaying the displayed information 140 in a pre-determined orientation, the upwardly-extending portion 121 creates a relatively larger footprint, thereby reducing the amount of products that can be displayed. The upwardly-extending portion 121 may also add cost to the packaging.

According to certain techniques disclosed herein, an item with an aperture is packaged in display packaging. The display packaging and the item are arranged on a conventional display peg such that the displayed information is automatically rotated whereby it is displayed in a substantially pre-determined orientation. For example, when the display packaging and the item are placed on the peg in a random orientation such that the displayed information is not in a substantially pre-determined orientation, the combination of the display packaging and the item packaged therein (collectively "the packaged item") automatically rights itself such that displayed information is displayed in a substantially pre-determined orientation. For example, text printed on the packaging may be substantially upright only when the packaged item is in the pre-determined orientation. The packaged item self-orients with the assistance of gravity. To accomplish this, the packaged item has a center of mass which is disposed at a lower elevation than the top of the peg when the packaged item is displayed in the pre-determined orientation on the peg. The pre-determined orientation of the displayed information may not be perfectly achieved due to, for example, friction between either of the display packaging or the item with the peg, or friction between two packaged items. Therefore, the pre-determined orientation need only be substantially achieved. The substantially pre-determined orientation facilitates relatively easier communication of the content of the displayed information to the customer than if the displayed information is not in the substantially pre-determined orientation. Further, the packaged item can be displayed at a relatively higher density than is possible than when a product is packaged with an upwardly-extending portion of the packaging (for example, a hang tag).

Figure 3:
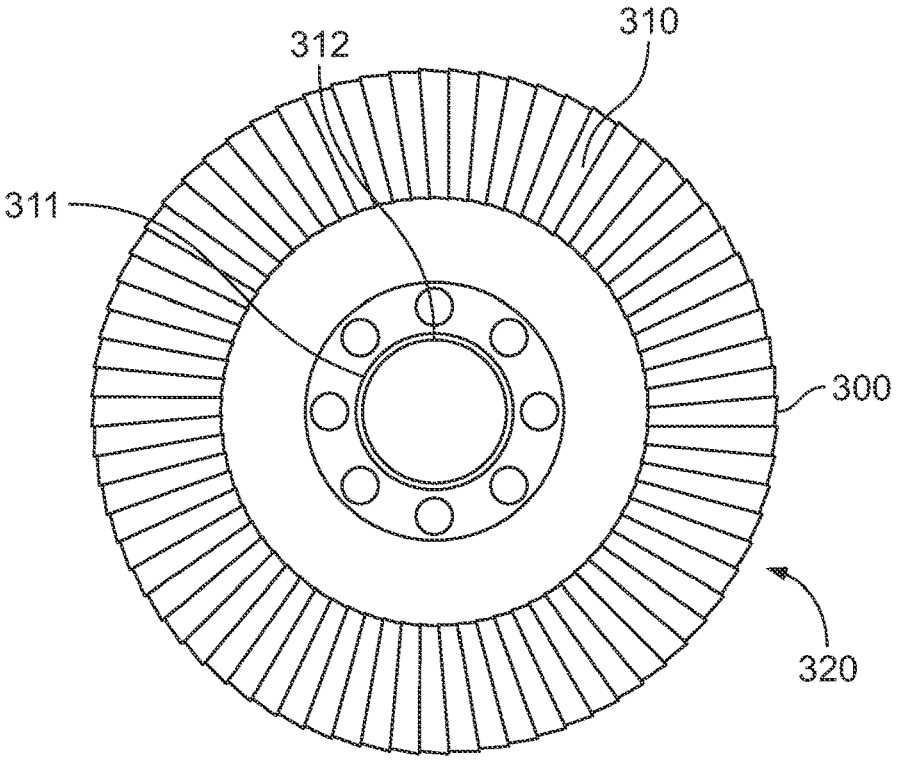
FIG. 3 illustrates an item for display.

FIG. 3 illustrates an item 300 with a front side 310 and a rear side 320. Such an item 300 may be, as an example without limitation, a product for sale in a retail setting, such as a hardware store. Such products include, for example, saw blades, cutting discs, grinding discs, or sanding discs. As depicted, the item 300 is a metal grinding and blending flap disc, which is rotationally symmetric. The item 300, however, could also be rotationally symmetric or asymmetric. A through opening 311 extends between the front side 310 and rear side 320. The through opening 311 defines an upper limit 312 when disposed in the pre-determined orientation.

Figure 4:
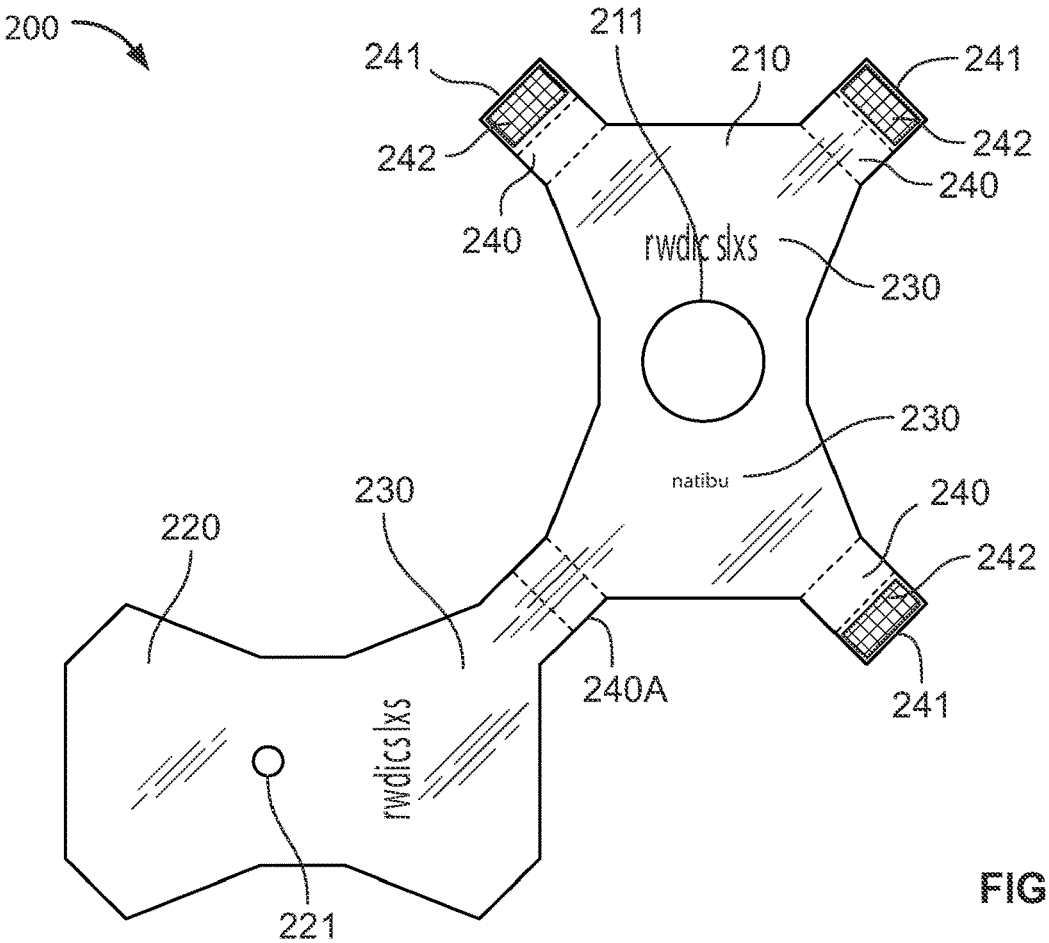
FIG. 4 illustrates one embodiment of a display packaging for packaging an item, according to the present invention.

FIG. 4 illustrates one embodiment of display packaging 200, which packages an item having an aperture (for example, item 300 having through opening 311). The display packaging 200 of the illustrated embodiment includes a front portion 210, a rear portion 220, and/or one or more connecting portions 240, 240A. The display packaging 200 is fabricated from a material such as cardboard, paper, plastic, metal foil, or any combination of the aforementioned. The display packaging 200 may be formed from a single sheet of such material. The display packaging 200 may be formed by cutting the material using any conventional method such as by stamping, or with lasers, shears, water cutter, saws, knives, or other blades. Portions of the display packaging 200 may be foldable (for example, along the broken lines as shown in FIG. 4) to form the final configuration that holds the item.

The display packaging 200 of the illustrated embodiment includes a front portion 210 that is positioned at least partially in front of the item 300, and a rear portion 220 positioned at least partially behind the item 300 when the display packaging 200 packages the item. The display packaging 200 may further include one or more connecting portions 240, 240A that facilitate connecting the front portion 210 to the rear portion 220. As shown in FIG. 4, three connecting portions 240 extend from the front portion 210 and terminate in tab portions 241 configured to be secured to the rear portion 220 in a conventional manner. In the illustrated embodiment, each tab portion 241 is provided with an adhesive 242 for adhering the tab portion 241 to the rear portion 220. It will be understood that there may be more or fewer connecting portions 240. It will be further understood that one or more of the connecting portions 240 may extend from the rear portion 220 as opposed to the front portion 210. It will also be understood that the adhesive 242 may be disposed on either side of the tab portions 241 such that the tab portions 241 may be disposed on either of an inside surface or an outside surface of the front portion 210 or rear portion 220. Further, an integrally formed connecting portion 240A can be provided to extend between the front portion 210 and the rear portion 220 such that the display packaging 200 is formed from a single piece of the selected material of manufacture. When assembled, the display packaging 200 defines a volume within which the item 300 is received.

As further illustrated in FIGS. 5A-5D, when the item 300 is received by the display packaging 200, it forms the packaged item 300P. The front portion 210 defines an aperture 211 positioned and dimensioned to register with at least a portion of the item 300 through opening 311 when the item 300 is received within the display packaging 200. Similarly, the rear portion 220 defines an aperture 221 positioned and dimensioned to register with at least a portion of each of the through opening 311 and the front portion aperture 211 when the item 300 is received within the display packaging 200. A through opening 311P in the packaged item 300P is formed by the co-registered portions of each of the item through opening 311, the front portion aperture 211, and the rear portion aperture 221. In embodiments with only one of a front portion 210 and rear portion 220 (as further discussed), the through opening 311P is formed by the co-registered portions of the item through opening 311 and one of the front portion aperture 211 (if the rear portion 220 is excluded) or the rear portion aperture 221 (if the front portion 210 is excluded). The through opening 311P is dimensioned such that a conventional display peg 110 may be received therethrough for the display of the packaged item 300P. Various embodiments of different through opening 311P arrangements are depicted in FIGS. 7A-7F.

The front portion 210 may also include displayed information 230 for display to a customer. The displayed information 230 has a preferred orientation that is pre-determined. Such a pre-determined orientation facilitates efficient communication of the content of the displayed information 230 to a customer. Such a pre-determined orientation may result in substantially upright text, drawings, or images when displayed to the customer. The through opening 311P defines an upper limit 312P defined as the uppermost position along the perimeter thereof when the packaged item 300P is oriented in the pre-determined orientation. To accomplish the positioning of the packaged item 300P in substantially the pre-determined orientation, the upper limit 312P of the through opening 311P is disposed above a center of mass 330 of the packaged item 300P. Various embodiments showing the relationship between packaged item through opening 311P, upper limit 312P, item through opening 311, front portion aperture 211, and rear portion aperture 221 are depicted in FIGS. 7A-7F.

Each of the front portion aperture 211 and the rear portion aperture 221 may be substantially circular, although other shapes are possible including irregular shapes. The front portion 210 may further include one or more cutaway boundaries that may form corresponding cutaways. Such cutaways may expose portion(s) of the item for customer viewing, simplify the step of packaging the item, and/or reduce cost of the display packaging 200 by reducing the amount of packaging material needed to package the item. Such a cutaway boundary is shown in FIG. 4 as a trapezoid-like contour on the right side of the front portion 210.

The rear portion 220 may further include one or more cutaway boundaries that form corresponding cutaways. Such cutaways may expose portion(s) of the packaged item for customer viewing, simplify item packaging, and/or reduce cost of the display packaging 200 by reducing the amount of packaging material needed to package the item. Such cutaway boundaries are shown in FIG. 4 as a trapezoid-like contours on the top and bottom sides of the rear portion 220.

The rear portion 220 may also include displayed information 230 intended to be displayed to a customer. The displayed information 230 may have a preferred orientation that is pre-determined. Such a pre-determined orientation facilitates efficient communication of the content of the displayed information 230 to a customer. Such a pre-determined orientation may result in substantially upright text, drawings, or images when displayed to the customer. The pre-determined orientation of the displayed information 230 on the rear portion 220 may be the same or a similar pre-determined orientation as the displayed information 230 on the front portion 210 once the display packaging 200 is assembled and holds the item. Before the display packaging 200 is fully assembled, however, the orientation of the displayed information 230 on the rear portion 220 may be different than the orientation of the displayed information 230 on the front portion 210. For example, as shown in FIG. 4, while the text on the front portion 210 is substantially upright, the text on the rear portion 220 is substantially horizontal. Once fully assembled, though, the orientations of the displayed information 230 on the front portion 210 and rear portion 220 may match.

Instead of having connecting portions 240, the front portion 210 and the rear portion 220 may directly connect to each other (not illustrated). For example, the front portion 210 and the rear portion 220 may touch or be integrated together at perimeter regions of the front and rear portions 210, 220. For example, the front portion 210 and rear portion 220 may directly connect in one or more locations. According to such a technique, it is possible for the front portion 210 and rear portion 220 to be connected along all but at least one side to form a sleeve. Such a sleeve (not illustrated) may have at least one unconnected region between the front portion 210 and the rear portion 220, where the unconnected region is sized to receive the item 300.

According to certain techniques not illustrated, the front portion 210 and rear portion 220 are completely separate—i.e., they are not connected via any connecting portion 240 or they are not directly connected together. Instead, the front portion 210 and/or rear portion 220 may be directly adhered, affixed, or otherwise attached to the front side 310 and/or rear side 320 of the item 300. This technique may otherwise be similar to those in which connecting portion(s) 240 are used or the front portion 210 and rear portion 220 are directly connected together.

The display packaging 200 in FIG. 4 may be assembled as follows, but not necessarily in the exact order. A single piece of material (e.g., cardboard) is formed or created in the shape that is shown. An item is placed on the display packaging 200 in a pre-determined location. Adhesive 242 is applied to the tab portions 241. The display packaging 200 is folded along the broken lines and bent around the item. The adhesive 242 is adhered to the back side of the rear portion 220, thereby completing assembly.

Figure 5A:
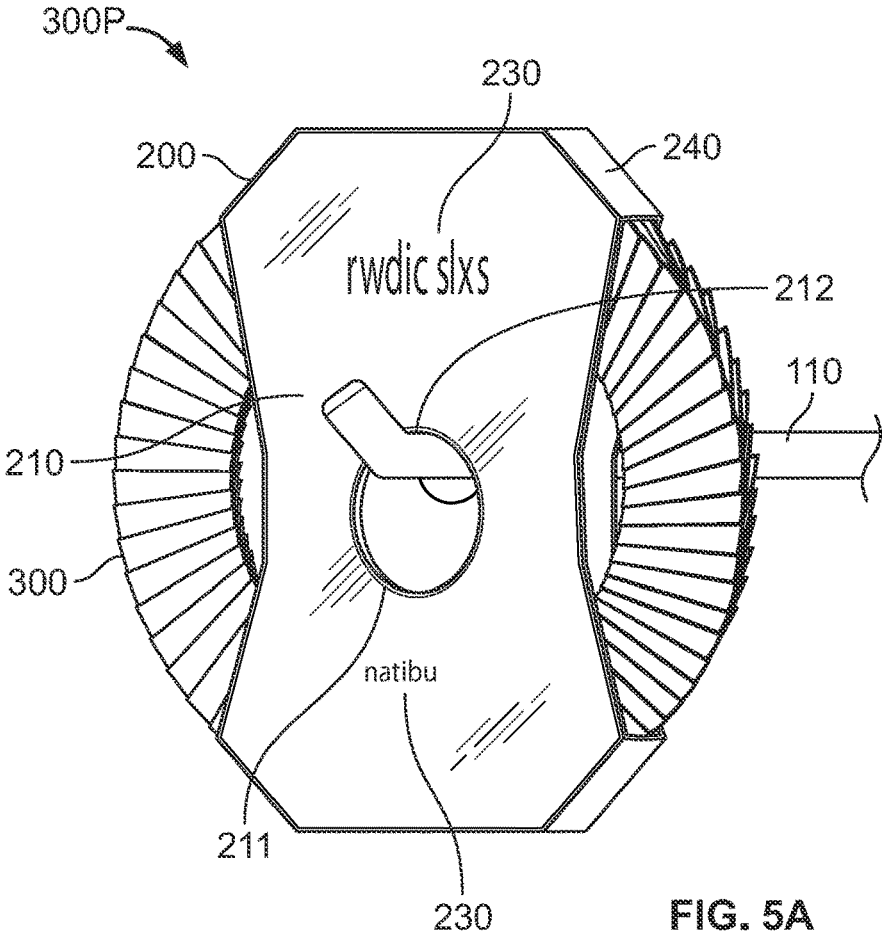
FIG. 5A illustrates a front perspective view of an item packaged in the display packaging of FIG. 4, wherein the packaged item is hanging from a peg, according to embodiments of the present invention.
Figure 5B:
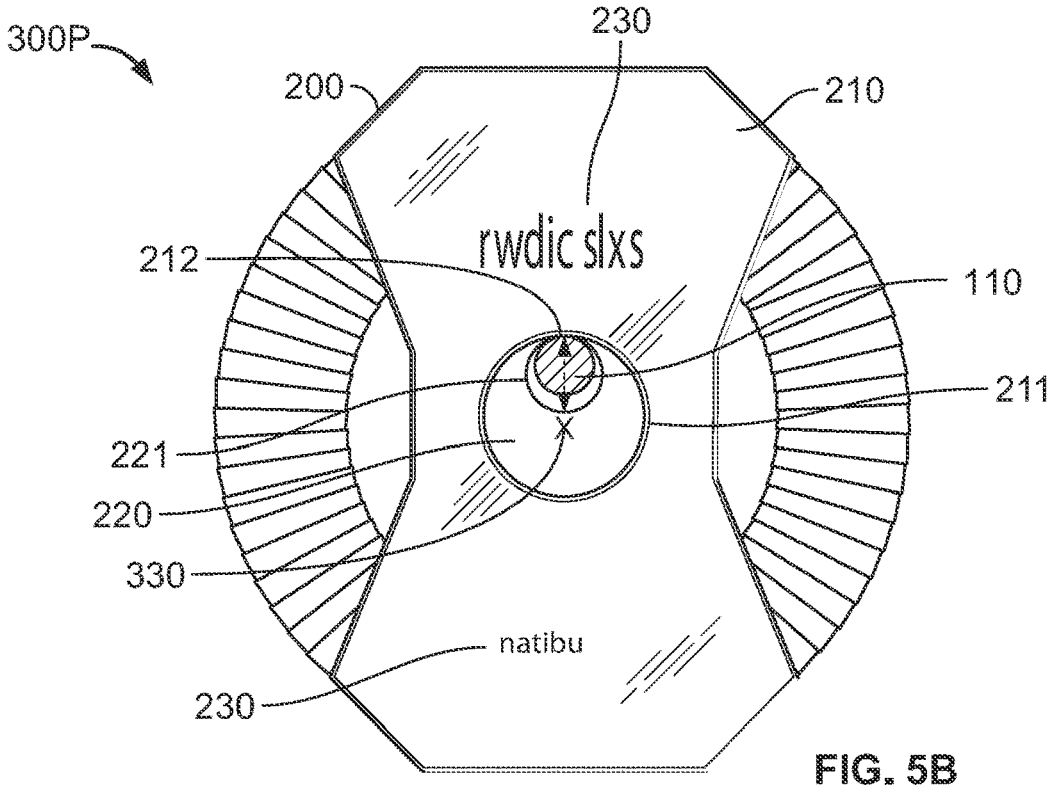
FIG. 5B illustrates a front elevation view of the packaged item and peg (shown in cross-section) of FIG. 5A, according to embodiments of the present invention.
Figure 5C:
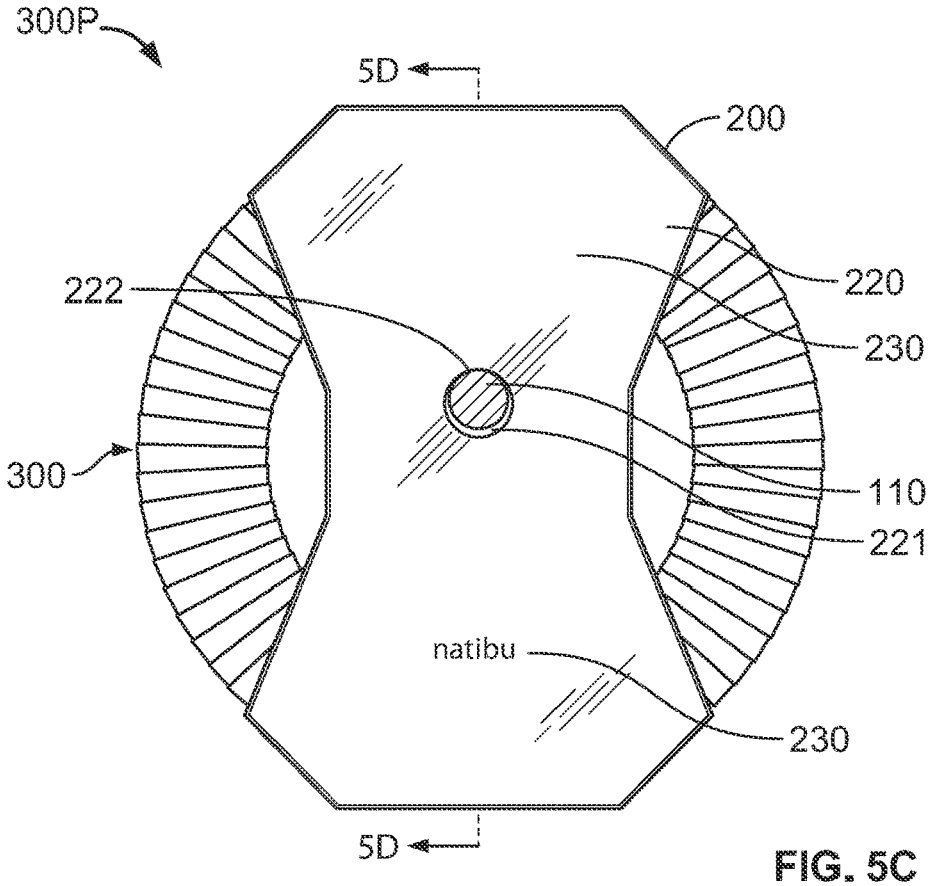
FIG. 5C illustrates a rear elevation view of the packaged item and peg (shown in cross-section) of FIG. 5A, according to embodiments of the present invention.
Figure 5D:
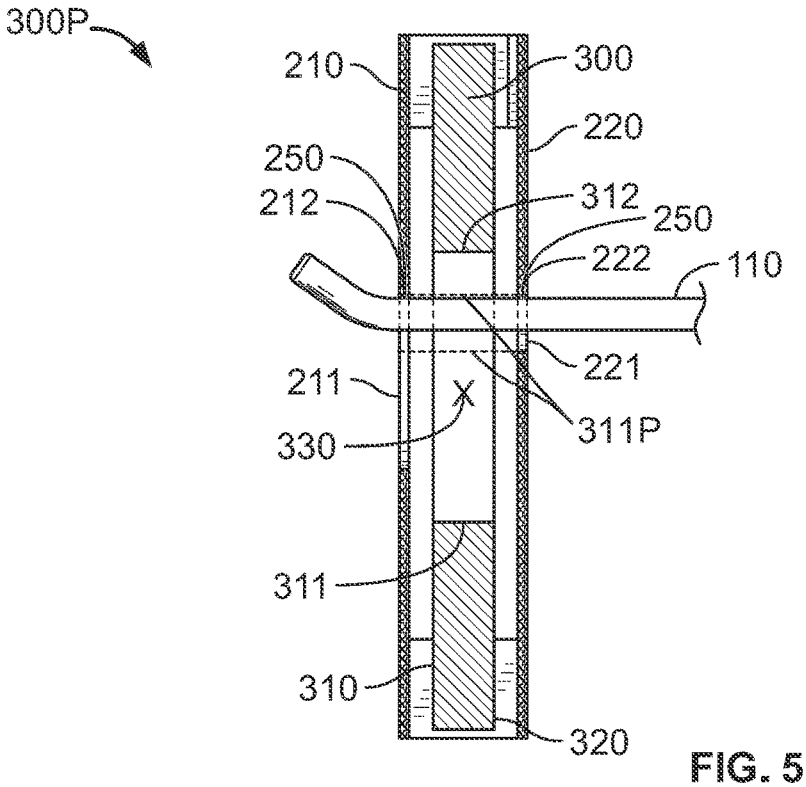
FIG. 5D illustrates a left-side cross-sectional representation, taken along lines 5D-5D in FIG. 5C, of the packaged item and peg of FIG. 5A, according to embodiments of the present invention.

FIGS. 5A-5D illustrate a packaged item 300P, including display packaging 200 that packages item 300. The packaged item 300P is shown in a resting orientation. FIG. 5A illustrates a front perspective view of the packaged item 300P hanging from the peg 110. FIG. 5B illustrates a front elevation view of the packaged item 300P. FIG. 5C illustrates a rear elevation view of the packaged item 300P. FIG. 5D illustrates a left-side cross-sectional representation of the packaged item hanging from the peg 110. The packaged item 300P defines a center of mass 330, which is depicted in FIGS. 5B and 5D as an "X". According to embodiments of the present invention, the packaged item 300P is arranged such that, when the packaged item 300P is resting on the peg 110, the center of mass 330 is maintained at an elevation below the point on which the package item 300P rests on the peg 110.

As can be seen in FIG. 5D, the peg 110 passes through the packaged item through opening 311P. As described above, the packaged item through opening 311P is defined by the co-registered portions of each of the front portion aperture 211, the rear portion aperture 221, and the item through opening 311. Each of these holes has an upper limit, respectively 212, 222, and 312. The upper limit 312P of the packaged item through opening 311P is the lower most of the upper limits 212, 222, and 312. The locations of the upper limits 212, 222, 312 are determined when the packaged item 300P is in the resting, or pre-determined orientation. As described herein, the upper limit 212 of the aperture 211 is a portion of the rim of the aperture 211 that is highest in elevation when the packaged item is in its resting, or pre-determined orientation. When the packaged item 300P is in a non-resting, or a not pre-determined orientation, the upper limit 212 is not at its highest elevation. Similarly, the upper limit 222 of the aperture 221 is a portion of the rim of the aperture 221 that is highest in elevation when the packaged item 300P is in its pre-determined orientation. When the packaged item is in a non-resting orientation, upper limit 222 is not at its highest elevation. Similarly, the upper limit 312 of the through opening 311 is a portion of the rim of the through opening 311 that is highest in elevation when the packaged item is in the pre-determined orientation. When the packaged item is not in the pre-determined orientation, the upper limit 312 is not at its highest elevation. In this configuration, it will be understood that the upper limit 312P is that one or more points along the perimeter of the packaged item through opening 311P that engage the conventional peg 110 when in the pre-determined orientation.

Figure 7A:
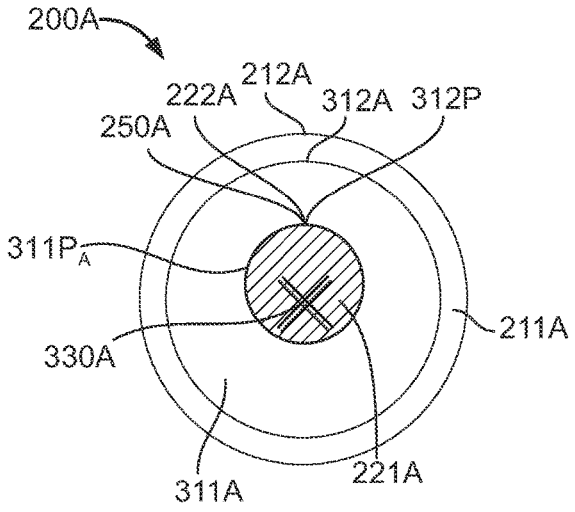
FIGS. 7A, 7B, 7C, 7D, 7E, 7F, and 7G illustrate different arrangements amongst a through hole in the item of FIG. 3, an aperture in the front portion of the packaged item as shown in FIG. 5B, and an aperture in the rear portion of the packaged item as shown in FIG. 5C, according to embodiments of the present invention.

FIG. 7A illustrates one arrangement 200A of the front portion aperture 211A having an upper limit 212A, rear portion aperture 221A having an upper limit 222A, and item through opening 311A having an upper limit 312A. The lowermost of the upper limits 212A, 222A, and 312A as illustrated is the rear portion aperture upper limit 222A. Accordingly, the upper limit 222A is also the packaged item through opening upper limit 312P as well as the resting location 250A. The co-registered parts of front portion aperture 211A, rear portion aperture 221A, and item through opening 311A form the packaged item through hole $311P_A$, which is indicated with shading. In this case, the packaged item through hole $311P_A$ is coextensive with the rear portion aperture 221A. The center of mass 330A is located below the packaged item through opening upper limit 312P when the packaged item 300P is in the pre-determined orientation.

Figure 7B:
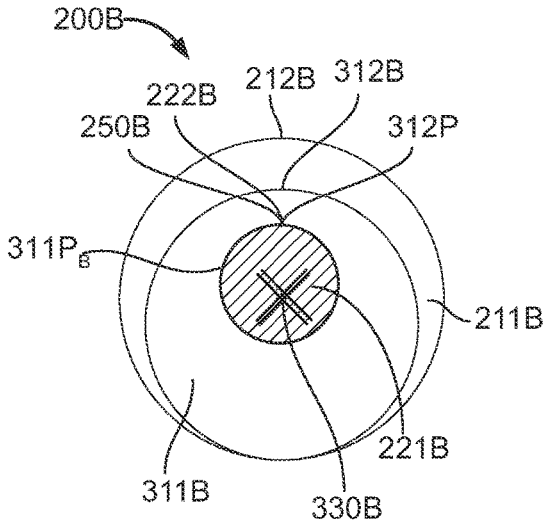

FIG. 7B illustrates one arrangement 200B of the front portion aperture 211B having an upper limit 212B, rear portion aperture 221B having an upper limit 222B, and item through opening 311B having an upper limit 312B. The lowermost of the upper limits 212B, 222B, and 312B as illustrated is the rear portion aperture upper limit 222B. Accordingly, the upper limit 222B is also the packaged item through opening upper limit 312P as well as the resting location 250B. The co-registered parts of front portion aperture 211B, rear portion aperture 221B, and item through opening 311B form the packaged item through hole $311P_B$, which is indicated with shading. In this case, the packaged item through hole $311P_B$ is coextensive with the rear portion aperture 221B. The center of mass 330B is located below the packaged item through opening upper limit 312P when the packaged item 300P is in the pre-determined orientation.

Figure 7C:
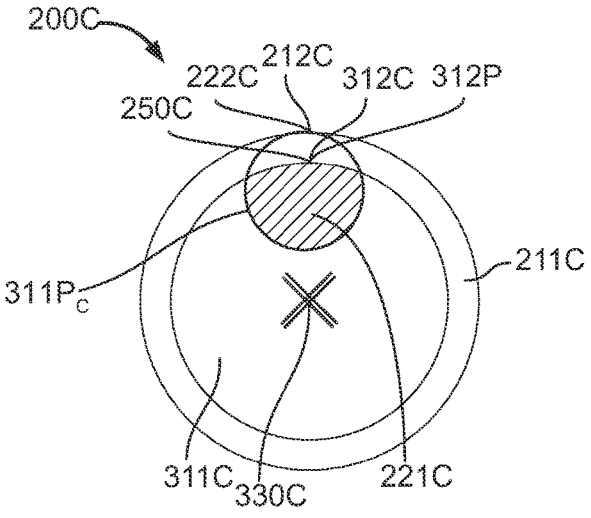

FIG. 7C illustrates one arrangement 200C of the front portion aperture 211C having an upper limit 212C, rear portion aperture 221C having an upper limit 222C, and item through opening 311C having an upper limit 312C. The lowermost of the upper limits 212C, 222C, and 312C as illustrated is the item through opening upper limit 312C. Accordingly, the upper limit 312C is also the packaged item through opening upper limit 312P as well as the resting location 250C. The co-registered parts of front portion aperture 211C, rear portion aperture 221C, and item through opening 311C form the packaged item through hole $311P_C$, which is indicated with shading. The center of mass 330C is located below the packaged item through opening upper limit 312P when the packaged item 300P is in the pre-determined orientation.

Figure 7D:
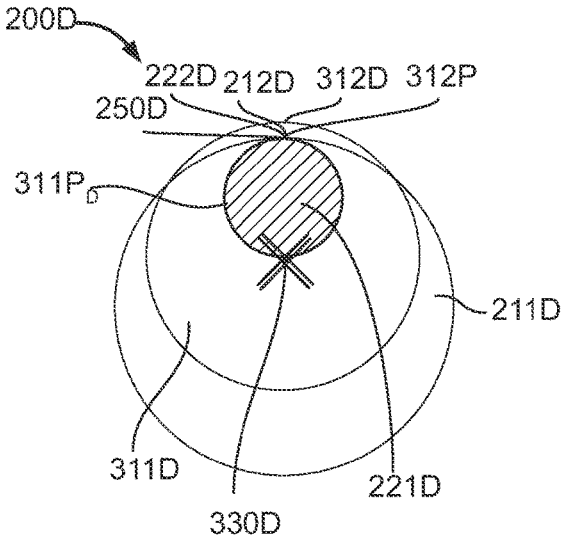

FIG. 7D illustrates one arrangement 200D of the front portion aperture 2111D having an upper limit 212D, rear portion aperture 221D having an upper limit 222D, and item through opening 311D having an upper limit 312D. The lowermost of the upper limits 212D, 222D, and 312D as illustrated is the rear portion aperture upper limit 222D (or front portion aperture upper limit 212D). Accordingly, the upper limit 222D is also the packaged item through opening upper limit 312P as well as the resting location 250D. The co-registered parts of front portion aperture 211D, rear portion aperture 221D, and item through opening 311D form the packaged item through hole $311P_D$, which is indicated with shading. In this case, the packaged item through hole $311P_D$ is coextensive with the rear portion aperture 221D. The center of mass 330D is located below the packaged item through opening upper limit 312P when the packaged item 300P is in the pre-determined orientation.

Figure 7E:
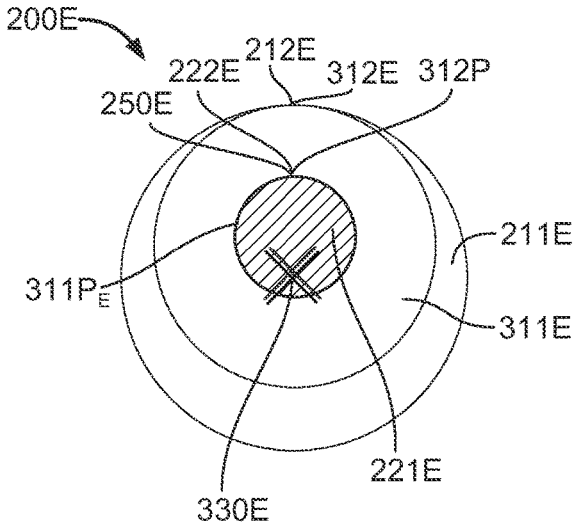

FIG. 7E illustrates one arrangement 200E of the front portion aperture 211E having an upper limit 212E, rear portion aperture 221E having an upper limit 222E, and item through opening 311E having an upper limit 312E. The lowermost of the upper limits 212E, 222E, and 312E as illustrated is the rear portion aperture upper limit 222E. Accordingly, the upper limit 222E is also the packaged item through opening upper limit 312P as well as the resting location 250E. The co-registered parts of front portion aperture 211E, rear portion aperture 221E, and item through opening 311E form the packaged item through hole $311P_E$, which is indicated with shading. In this case, the packaged item through hole $311P_E$ is coextensive with the rear portion aperture 221E. The center of mass 330E is located below the packaged item through opening upper limit 312P when the packaged item 300P is in the pre-determined orientation.

Figure 7F:
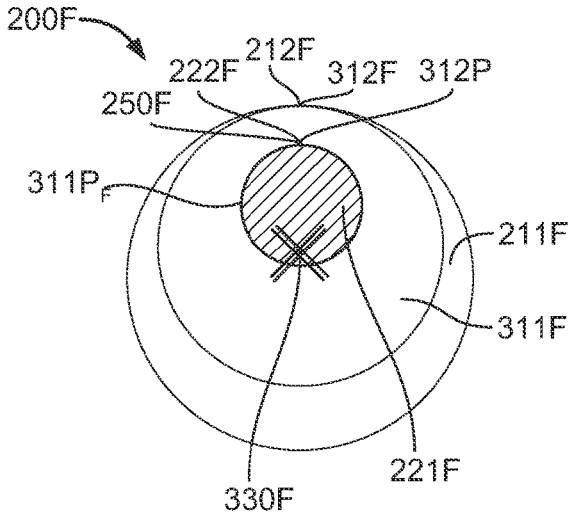

FIG. 7F illustrates one arrangement 200F of the front portion aperture 211F having an upper limit 212F, rear portion aperture 221F having an upper limit 222F, and item through opening 311F having an upper limit 312F. The lowermost of the upper limits 212F, 222F, and 312F as illustrated is the rear portion aperture upper limit 222F. Accordingly, the upper limit 222F is also the packaged item through opening upper limit 312P as well as the resting location 250F. The co-registered parts of front portion aperture 211F, rear portion aperture 221F, and item through opening 311F form the packaged item through hole $311P_F$, which is indicated with shading. In this case, the packaged item through hole $311P_F$ is coextensive with the rear portion aperture 221F. The center of mass 330F is located below the packaged item through opening upper limit 312P when the packaged item 300P is in the pre-determined orientation.

Figure 7G:
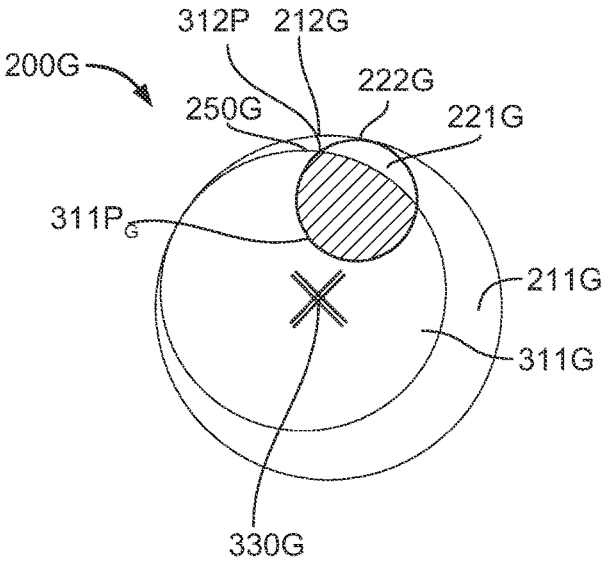

FIG. 7G illustrates one arrangement 200G of the front portion aperture 211G having an upper limit 212G, a rear portion aperture 221G having an upper limit 222G, and an item through opening 311G having an upper limit 312G. The packaged item through opening upper limit 312P and the resting location 250G is at the intersection between the perimeters of the rear portion aperture 211G and the item aperture 311G. The co-registered parts of the front portion aperture 211G, the rear portion aperture 221G, and item through opening 311G form the packaged item through hole 311$P_G$, which is indicated with shading. The center of mass 330G is located below the packaged item through opening upper limit 312P when the packaged item 300P is in the pre-determined orientation. Unlike the depictions in each of FIGS. 7A-7F, each of the apertures 211G, 221G, and 311G have centers, which are not collinear with each other along a vertical axis. Such an arrangement, whereby one or more of the apertures are not collinear along a vertical axis with the other aperture(s), is also within the scope of the present invention.

As shown in FIG. 5B, the center of mass 330 (center of mass indicated with "X") is offset in elevation from the upper limit 212 of aperture 211, as shown by the broken line with arrowheads. The display packaging 200 maintains the center of mass 330 in a substantially fixed relationship with respect to the upper limit 212 of the front portion aperture 211. Similarly, or alternatively, the display packaging 200 maintains the center of mass 330 in a substantially fixed relationship with respect to the upper limit 222 of the rear portion aperture 221.

As shown in FIG. 5D, the front portion aperture upper limit 212 and rear portion aperture upper limit 222 contact the peg 110 while the peg is in a substantially horizontal orientation. Gravity causes the upper limits 212, 222 to contact the peg 110. The upper limit 312 of the item through opening 311, however, does not contact the peg 110. The center of mass 330 is maintained at a position below the top of the peg 110, or below the upper limits 212, 222. Alternatively, the upper limits 212, 312 may touch the peg 110, whereas the upper limit 222 does not. Alternatively, the upper limits 222, 312 may touch the peg 110, whereas the upper limit 212 does not. The packaged item through hole 311P, which is depicted by two horizontal broken lines, is formed by the co-registered portions of front portion aperture 211, rear portion aperture 221, and item aperture 311. As depicted, the top of the packaged item through hole 311P also defines the packaged item through hole upper limit 312P.

The display packaging 200 maintains the packaged item such that the center of mass 330 is at an elevation below the top of the peg 110 when the packaged item is in its resting, or pre-determined orientation. The display packaging 200 may maintain the item 300 such that the center of mass 330 is concentric with one or more of apertures 211, 221. The display packaging 200 may maintain the item 300 such that the through opening 311 is concentric with one or more of the apertures 211, 221. The display packaging 200 may maintain the item 300 such that, when the packaged item is in the pre-determined orientation, the center of mass 330 is at an elevation below the center of one or more of the apertures 211, 221.

Figure 6A:
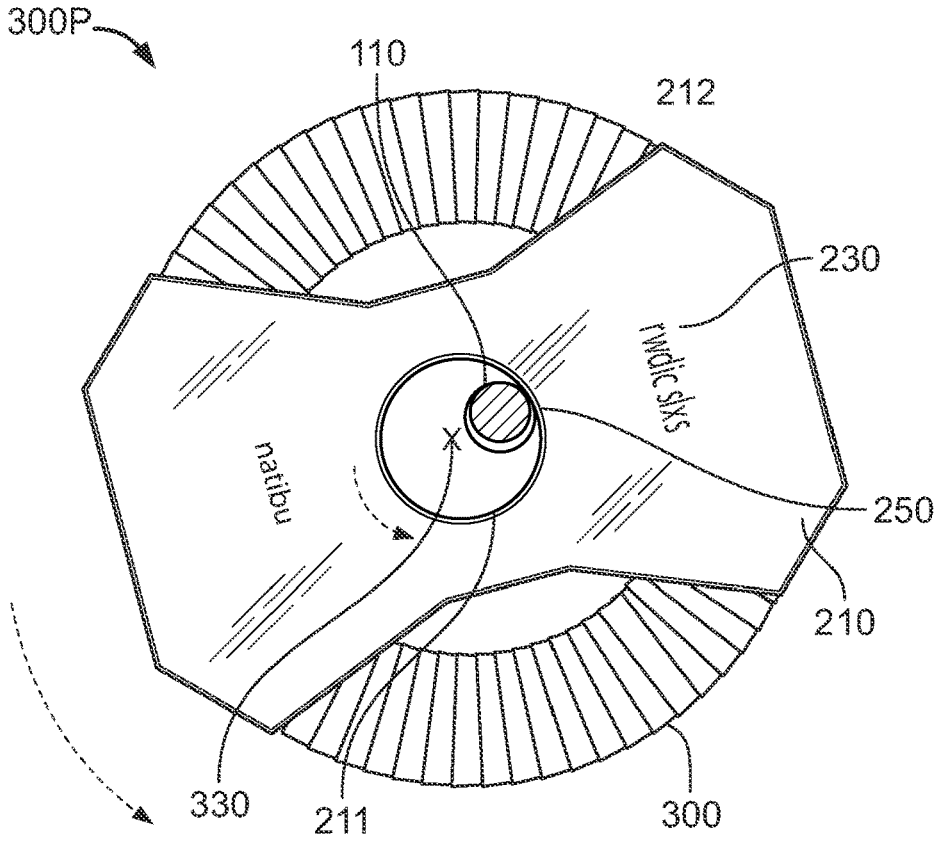
FIG. 6A illustrates a front elevation view of the packaged item FIG. 5A hanging from a peg, wherein the packaged item is in a non-resting orientation with respect to the peg, according to embodiments of the present invention.
Figure 6B:
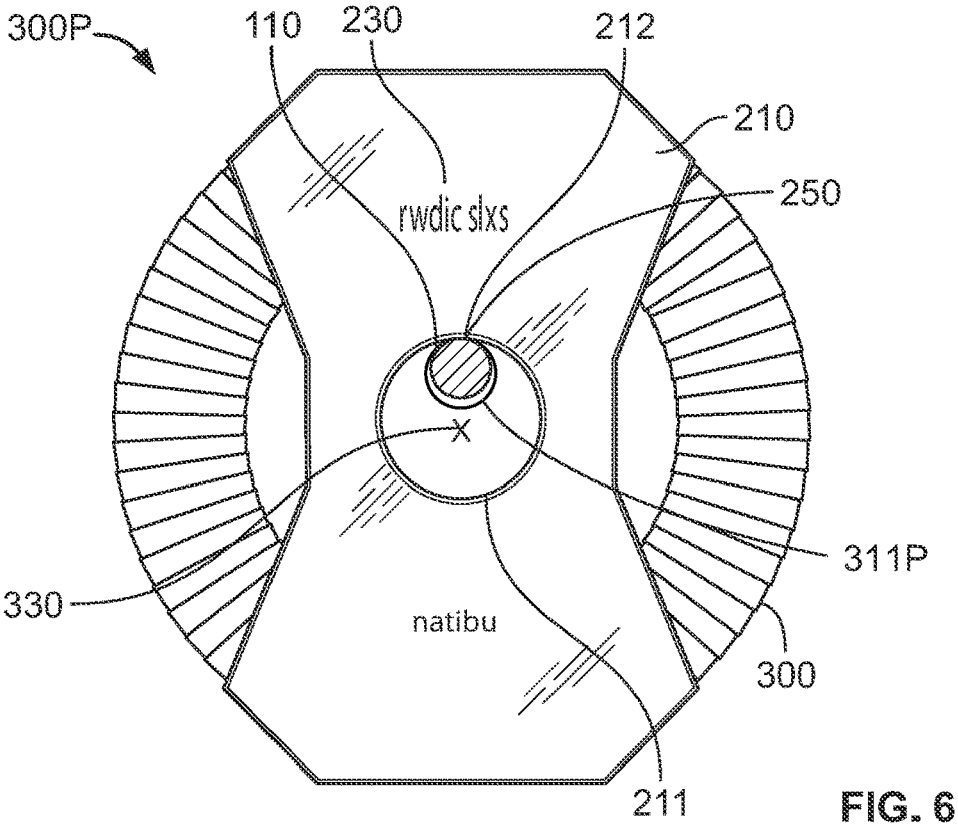
FIG. 6B illustrates a front elevation view of the packaged item hanging from a peg, wherein the packaged is in a resting orientation with respect to the peg, according to embodiments of the present invention.

FIG. 6A illustrates a front elevation view of the packaged item 300P hanging from the peg 110, wherein the packaged item 300P is in a non-resting orientation with respect to the peg 110. FIG. 6B illustrates a front elevation view of the packaged item 300P hanging from a peg 110, wherein the packaged item 300P is in a resting orientation with respect to the peg 110. The center of mass 330 may be constrained such that when the packaged item 300P is rotated from the pre-determined orientation, the elevation of the center of mass 330 with respect to the peg 110 changes. When the packaged item 300P is in its pre-determined orientation, the center of mass 330 is at its substantially lowest elevation with respect to the peg 110. When the packaged item 300P is in a non-resting orientation, the center of mass 330 is at higher elevation with respect to the peg 110 than when the packaged item 300P is in the pre-determined orientation. Acting under the influence of gravity, when the packaged item 300P is in a non-resting orientation, the center of mass 330 tends to move to its lowest elevation with respect to the peg 110 as indicated by a shorter broken line. The lowest elevation corresponds to the pre-determined orientation of the packaged item 300P. Because of the constraints of the system, when the center of mass 330 drops down, the location of the center of mass 330 rotates with respect to the peg 110. As the center of mass 330 rotates, the display packaging 200 rotates by the same amount (for example, the same number of degrees of rotation) as well, as indicated by the longer broken line.

As shown in FIG. 6A, when the packaged item is in a non-resting orientation, the displayed information 230 is not in a pre-determined orientation. In this orientation, it may be more difficult for the customer to process and understand the content of the displayed information 230. For example, the text shown is not in an upright position, thereby making it more difficult to read. As depicted, the "resting location" 250 is coextensive with the "upper limit" 212 of the aperture 211. But when the packaged item 300P is in a non-resting orientation, the resting location 250 or upper limit 212 is not at its uppermost elevation. As shown in FIG. 6B, when the packaged item 300P is in the resting orientation, the displayed information 230 is in the pre-determined orientation. In this orientation, it may be easier for the customer to process and understand the content of the displayed information 230. For example, the text shown is in an upright position, thereby making it easier to read. Note, in this orientation, the resting location 250 or upper limit 212 is at its uppermost elevation.

Figure 8A:
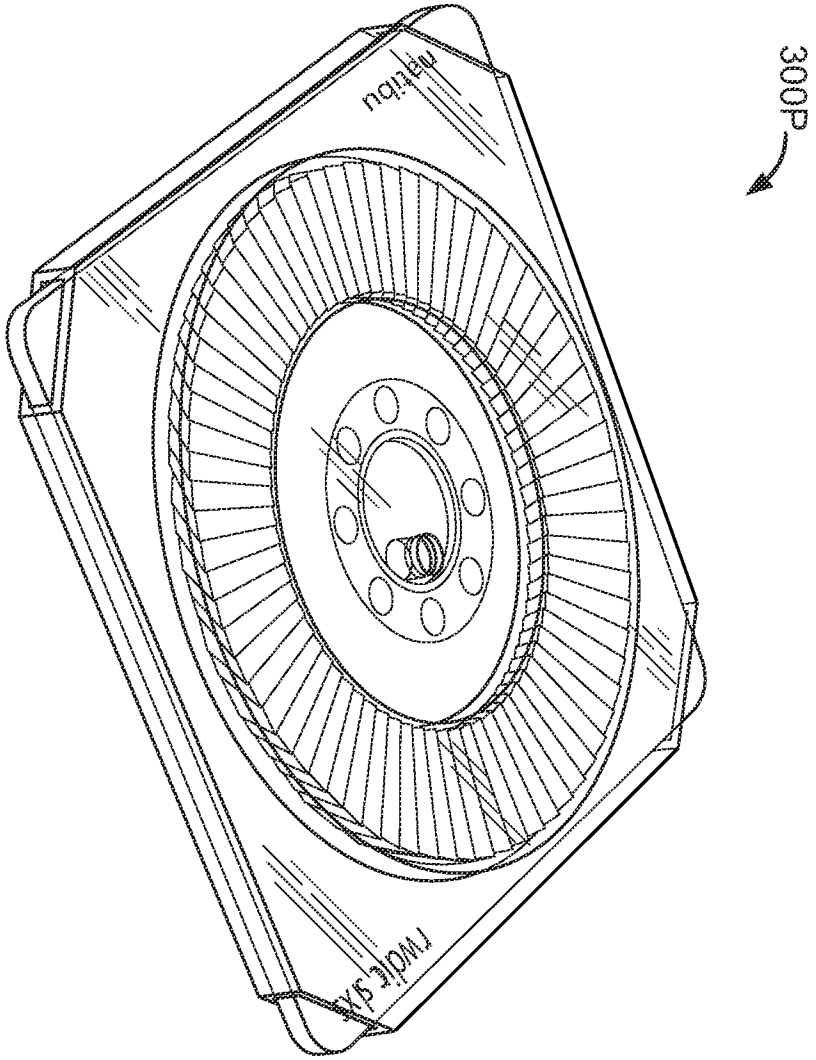
FIGS. 8A, 8B, and 8C illustrate a front perspective view, a rear perspective view, and a cross-sectional representation, respectively, of a packaged item designed to hang from a peg, according to embodiments of the present invention.
Figure 8B:
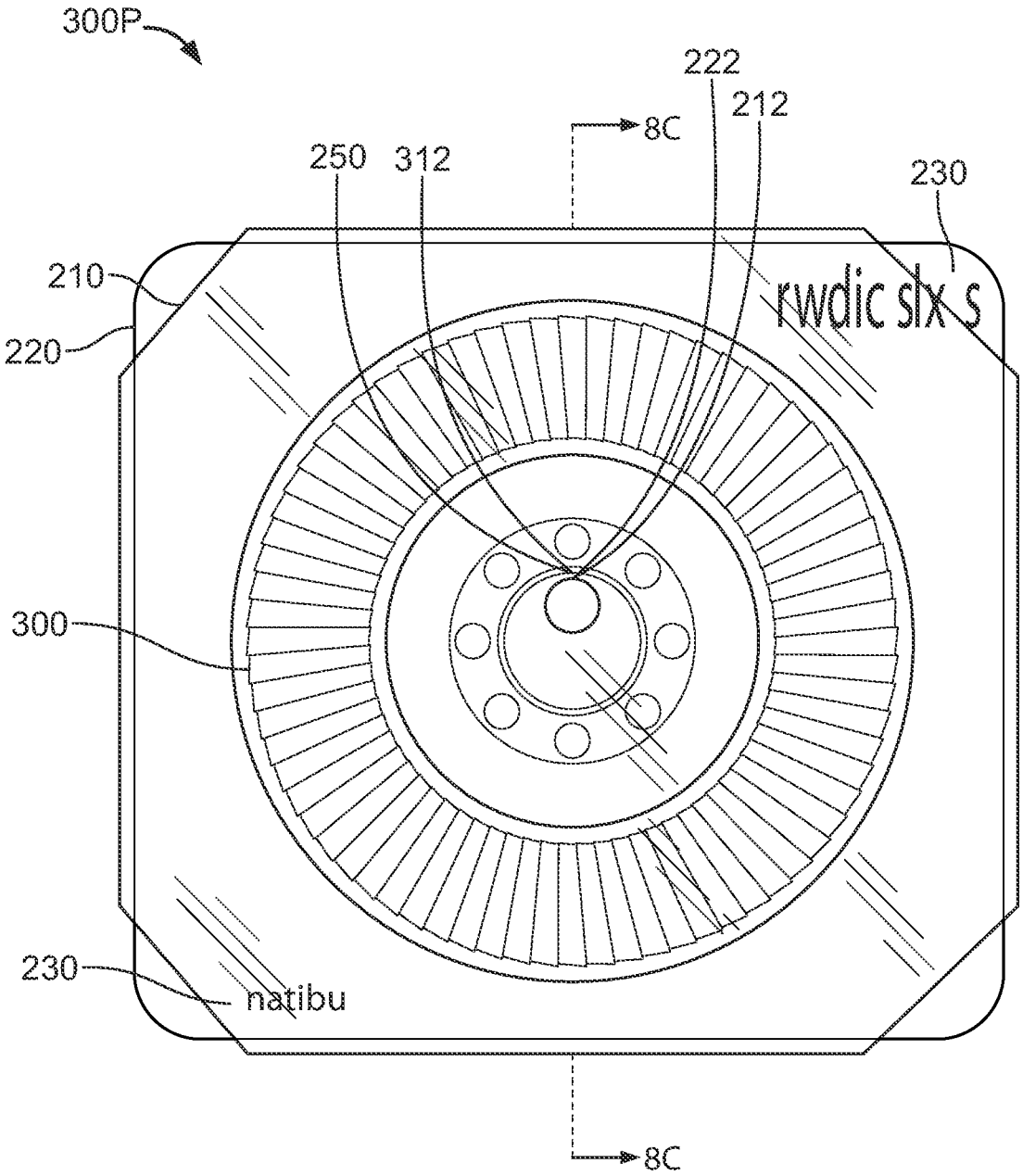
Figure 8C:
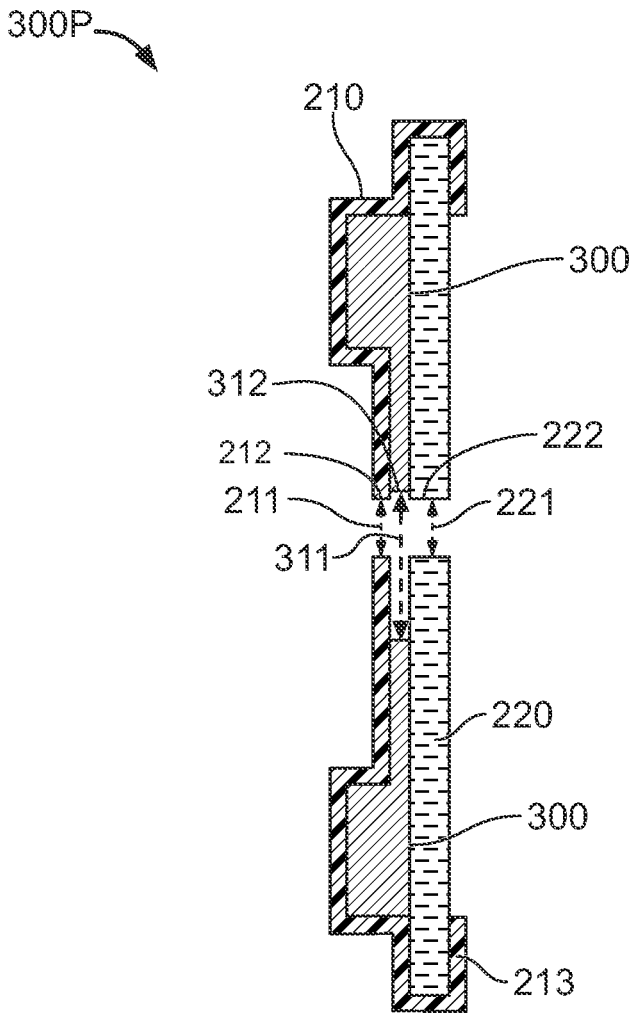

FIGS. 8A-8C illustrate an embodiment that utilizes some of the same principles discussed above. These figures illustrate a front perspective view, a front elevational view, and a right-side cross-sectional representational view, respectively, of a packaged item 300P including item 300 packaged in display packaging 200. The peg 110 is not depicted in these figures, but it should be understood that the peg 110 interacts with the packaged item 300P in a manner similar to that depicted in FIGS. 5A-5D, 6A, and 6B.

The techniques illustrated in FIGS. 8A-8C may be similar in many respects to those described above with respect to FIGS. 5A-5D, 6A, 6B, and 7A-7F. For example, the packaging 200 includes a front portion 210 and a rear portion 220. The front portion 210 may include a material such as thermoformed plastic. Such a material may be substantially transparent, such that the rear portion 220 is viewable through the front portion 210. In such an arrangement, display information 230 may be provided on the frontward facing side of the rear portion 220. As depicted in FIG. 8C, the front portion 210 includes features 213 that retain the rear portion 220 without adhesive or integrated connecting portions. As depicted in FIG. 8C, the features 213 wrap around at least some of the outer edges of the front portion 210 to retain the rear portion 220 and maintain item 300 therebetween. Other configurations or features 213 may operate to engage the front portion 210 and rear portion 220, such as mating tabs and slots. Alternatively, the front portion 210 may be adhered to the front-facing surface of the rear portion 220, such that features 213 are not needed.

The front portion 210, the rear portion 220, and the item 300 each have apertures 211, 221, and 311, respectively. The apertures 211, 221, 311 align to receive the peg 110. As depicted, the resting location 250 is coextensive with upper limits 212, 222, but other arrangements are also possible as explained in relation to other embodiments herein. The upper limits 212, 222, and/or 312 of the respective apertures 211, 221, and/or 311 may abut or rest upon an upper surface of the peg 110. The center of mass 330 of the packaged item is constrained with respect to the position of one or more of the upper limits 212, 222, 312 of the apertures 211, 221, 311. The packaged item 300P self-rights itself when it is placed in a non-resting orientation on the peg 110 by automatically transitioning to the resting or pre-determined orientation. When in the pre-determined orientation, displayed information 230 is also in a pre-determined orientation for viewing by the customer.

While embodiments of the invention have been described to include a rear portion and a front portion of the packaging, the techniques are similarly applicable to a packaged item with only one of a front portion or a rear portion and the item itself. For example, the item may be adhered to the front portion such that a rear portion is not necessary, or vice versa. As another example, either the front portion or the rear portion may have features that retain the item, thereby obviating the need for a rear portion. In either of these embodiments, the item may be removed from the packaging by pulling or cutting off the packaging from the item.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. Display packaging configured to form a packaged item by packaging an item and to receive a display peg, wherein the item includes a through hole through which the display peg is receivable, wherein the packaged item has a center of mass, and wherein the display peg is substantially horizontal, the display packaging comprising:

a front portion configured to be positioned at least partially in front of the item, wherein the front portion includes an aperture, wherein at least a portion of the front portion aperture is co-registered with at least a portion of the through hole of the item;

a rear portion configured to be positioned at least partially in back of the item, wherein the rear portion includes an aperture, wherein at least a portion of the rear portion aperture is co-registered with at least a portion of the front portion aperture and at least a portion of the through hole of the item to define a packaged item through opening configured to receive the display peg; and wherein, when the display peg is received by the packaged item through opening, the packaged item is rotatable to a plurality of non-resting orientations and only one resting orientation with respect to the display peg, wherein, when in the resting orientation, the center of mass of the packaged item is lower than an upper limit of the packaged item through opening, and wherein, when the packaged item is in any of the non-resting orientations, the packaged item automatically rotates to the resting orientation.

2. The display packaging of claim 1, further comprising displayed information displayed in a pre-determined orientation when the packaged item is in the resting orientation.

3. The display packaging of claim 2, wherein at least a portion of the displayed information is on the frontward face of the front portion.

4. The display packaging of claim 2, wherein at least a portion of the displayed information is on the frontward face of the rear portion.

5. The display packaging of claim 1, further comprising at least one connecting portion connected to the front portion and the rear portion when the display packaging packages the item.

6. The display packaging of claim 5, wherein the at least one connecting portion comprises a plurality of connecting portions.

7. The display packaging of claim 6, wherein the plurality of connecting portions comprises four connecting portions.

8. The display packaging of claim 6, further comprising adhesive on at least a subset of the plurality of connecting portions.

9. The display packaging of claim 6, wherein one of the plurality of connecting portions includes a region integrally connected to both the front portion and the rear portion.

10. The display packaging of claim 1, wherein, when the display packaging packages the item, the front portion directly contacts the rear portion.

11. The display packaging of claim 10, wherein the front portion comprises thermoformed plastic.

12. The display packaging of claim 10, wherein the front portion comprises thermoformed plastic and the rear portion comprises cardboard.

13. The display packaging of claim 1, wherein the item is rotationally symmetric.

14. The display packaging of claim 1, wherein the item is rotationally asymmetric.

15. The display packaging of claim 1, wherein the rear portion aperture has a circular shape.

16. The display packaging of claim 1, wherein the front portion aperture has a circular shape.

17. The display packaging of claim 1, wherein only a portion of the front surface of the item is visible when viewing the display packaging from the front.

18. The display packaging of claim 1, wherein the entire front surface of the item is visible when viewing the display packaging from the front.

19. The display packaging of claim 1, wherein the front portion aperture is larger than the rear portion aperture.

20. The display packaging of claim 1, wherein the front portion comprises a substantially transparent material such that displayed information on a frontward surface of the rear portion is discernable through the front portion.

* * * * *